US009814330B2

(12) United States Patent
DiMeo

(10) Patent No.: US 9,814,330 B2
(45) Date of Patent: Nov. 14, 2017

(54) PIZZA SLICE CONTAINER

(71) Applicant: PIZZA ON "DA" GO, LLC, Annapolis, MD (US)

(72) Inventor: Michele N. DiMeo, Annapolis, MD (US)

(73) Assignee: PIZZA ON "DA" GO, LLC, Annapolis, MD (US)

( * ) Notice: Subject to any disclaimer, the term of this patent is extended or adjusted under 35 U.S.C. 154(b) by 35 days.

(21) Appl. No.: 14/134,646

(22) Filed: Dec. 19, 2013

(65) Prior Publication Data

US 2014/0174039 A1 Jun. 26, 2014

Related U.S. Application Data

(60) Provisional application No. 61/740,933, filed on Dec. 21, 2012.

(51) Int. Cl.
*B65D 5/00* (2006.01)
*B65D 5/50* (2006.01)
(Continued)

(52) U.S. Cl.
CPC ..... *A47G 19/02* (2013.01); *A45C 11/20* (2013.01); *B65D 43/162* (2013.01); *B65D 43/163* (2013.01); *B65D 2585/366* (2013.01)

(58) Field of Classification Search
CPC ..... B65D 2585/366; B65D 2581/3406; B65D 2543/00194; B65D 43/16; B65D 43/163;
(Continued)

(56) References Cited

U.S. PATENT DOCUMENTS 851,357 A * 4/1907 Keefe ..... 220/831
1,490,341 A * 4/1924 Olney ..... A47G 19/18 206/457

(Continued)

FOREIGN PATENT DOCUMENTS

CN 1280946 A 1/2001
CN 1537788 A 10/2004
CN 202265094 U 6/2012

OTHER PUBLICATIONS

Chinese Office Action dated Oct. 24, 2016 in Chinese Patent Application No. 201310716762.7.

*Primary Examiner* — J. Gregory Pickett
*Assistant Examiner* — Gideon Weinerth
(74) *Attorney, Agent, or Firm* — Venable LLP; Steven J. Schwarz

(57) ABSTRACT

A pizza slice container includes an upper member having an upper surface; a lower member having a bottom surface and at least one sidewall, the lower member attached to the upper member by at least one hinge, wherein the upper surface and the bottom surface are opposed. The upper member includes at least one retention spike extending from the upper surface of the upper member toward the bottom surface of the lower member. The lower member includes at least one retaining tab extending substantially perpendicular from a sidewall of the lower member; and at least one rib extending from the bottom surface of the lower member toward the upper surface of the upper member. The upper and lower members are movable with respect to one another between an open position and a closed position. Other embodiments of the pizza slice container, and methods for its use, are described herein.

8 Claims, 10 Drawing Sheets

(51) Int. Cl.

| | |
|---|---|
| ***B65D 43/02*** | (2006.01) |
| ***A47G 19/02*** | (2006.01) |
| ***A45C 11/20*** | (2006.01) |
| ***B65D 43/16*** | (2006.01) |

(58) Field of Classification Search

CPC ..... B65D 81/263; B65D 81/3813; A47G 21/001; A47G 19/02; A47G 19/03

USPC ..... 426/112, 115

See application file for complete search history.

(56) References Cited

U.S. PATENT DOCUMENTS 2,020,534 A * 11/1935 Brown ..... 206/477
2,452,969 A * 11/1948 Victor ..... B65D 11/00 206/550
2,506,256 A 5/1950 Waldo
2,583,915 A * 1/1952 Whitley ..... 229/107
2,595,403 A * 5/1952 Neuschaefer ..... A45D 40/06 206/385
2,602,540 A 7/1952 Hurst
2,789,608 A 4/1957 Tupper
2,928,537 A * 3/1960 Stagner ..... 206/493
3,180,739 A * 4/1965 Stoker ..... 426/94
3,335,846 A * 8/1967 Mills ..... B65D 11/02 206/550
3,620,403 A 11/1971 Rump
3,620,411 A 11/1971 Rump
3,771,713 A * 11/1973 Davidson ..... B65D 5/48004 206/551
4,260,060 A * 4/1981 Faller ..... B65D 81/3453 219/732
4,360,118 A * 11/1982 Stern ..... B65D 1/34 206/545
4,373,636 A 2/1983 Hoffman
4,700,843 A * 10/1987 Cohen ..... 206/521
4,784,273 A 11/1988 Niemetz
4,811,846 A * 3/1989 Bottega ..... 206/542
4,848,543 A * 7/1989 Doboze ..... B65D 1/34 206/523
4,883,195 A * 11/1989 Ott et al. ..... 220/839
4,886,179 A 12/1989 Volk
4,947,993 A 8/1990 Bruml et al.
5,076,434 A * 12/1991 Hoffman, Jr. ..... 206/509
5,076,437 A 12/1991 Schindler
D323,236 S * 1/1992 Copp ..... D1/106
D323,921 S * 2/1992 Kawchak ..... D1/129
D328,426 S 8/1992 Berzon
D336,589 S 6/1993 Schindler
D341,539 S 11/1993 Davis et al.
5,381,905 A * 1/1995 Mallmamm ..... A47G 21/001 206/551
5,472,139 A * 12/1995 Valdman et al. ..... 229/407
5,501,141 A * 3/1996 Mendez et al. ..... 99/426
5,509,601 A * 4/1996 Drabick ..... 229/199
5,542,540 A * 8/1996 Knapp et al. ..... 206/525
5,600,889 A * 2/1997 Marotta ..... 30/142
5,605,231 A * 2/1997 Borsboom ..... A47J 47/145 206/204
D391,808 S 3/1998 Voege
D392,883 S 3/1998 Ferrin
5,759,119 A * 6/1998 Ayoub ..... 473/387
5,954,561 A * 9/1999 Cannone ..... A63H 33/001 434/127
D418,371 S 1/2000 Whitehead
D419,364 S 1/2000 Jarvis
6,070,791 A 6/2000 Correll
6,150,635 A * 11/2000 Hannon ..... A47J 37/0629 219/386
D439,161 S 3/2001 Rondolino
6,230,917 B1 5/2001 Whitnell
6,257,434 B1 * 7/2001 Lizzio ..... 220/4.23
6,299,918 B1 * 10/2001 Morgese ..... 426/112
D455,318 S 4/2002 Miller
D455,614 S 4/2002 Miller
6,595,366 B1 * 7/2003 Brown ..... 206/551
D480,512 S 10/2003 Sheng
6,629,607 B1 10/2003 Gibson
6,905,065 B2 * 6/2005 Holden ..... A47G 21/001 229/103
D507,453 S 7/2005 Mills
7,004,377 B2 * 2/2006 Metcalf ..... 229/115
D530,197 S 10/2006 LaMasney
7,331,459 B2 * 2/2008 Hilbourne ..... B65D 81/24 206/525
D604,118 S 11/2009 Braidotti
D698,613 S * 2/2014 DiMeo ..... D7/628
2004/0035863 A1 * 2/2004 Metcalf ..... A47G 21/001 219/734
2004/0094610 A1 * 5/2004 Longo ..... B65D 81/368 229/116.1
2006/0226206 A1 * 10/2006 Reap ..... A47G 21/001 229/103
2007/0012755 A1 1/2007 Metcalf
2008/0237328 A1 * 10/2008 Philips ..... B65D 5/2028 229/125.19
2009/0057381 A1 * 3/2009 Gokhale ..... B65D 1/26 229/104
2010/0301056 A1 * 12/2010 Wolfe ..... 220/592.01
2012/0292312 A1 * 11/2012 Chang ..... 220/4.24
2014/0262920 A1 * 9/2014 Andrews ..... B65D 81/261 206/551

* cited by examiner

PIZZA SLICE CONTAINER

CROSS-REFERENCE TO RELATED APPLICATIONS

This application claims priority to U.S. Provisional Application No. 61/740,933 filed Dec. 21, 2012, the disclosure of which is incorporated herein by reference in its entirety.

BACKGROUND

Take-out and delivery foods, such as pizzas, have long been desired by consumers as a quick meal option. Meals that are ready to eat—either delivered or taken to go—are well known and widely desired. Various types of packaging have been produced for these types of meals including, for example, various types of paper and plastic single-use containers as well as plastic and glass reusable containers. A well-known type of container is the widely used cardboard pizza box. The different types of boxes and containers may accommodate a family sized meal or a single serving.

SUMMARY

According to an embodiment, a food container comprises an upper member having an upper surface; a lower member having a bottom surface and at least one sidewall, the lower member attached to the upper member by at least one hinge, wherein the upper surface and the bottom surface are opposed; at least one retention spike extending from the upper surface of the upper member toward the bottom surface of the lower member; at least one retaining tab extending substantially perpendicular from a sidewall of the lower member; and at least one rib extending from the bottom surface of the lower member toward the upper surface of the upper member; wherein the upper and lower members are movable with respect to one another between an open position and a closed position.

According to another embodiment, a pizza slice container comprises an upper member having an upper surface; a lower member having a bottom surface and a rear wall, the lower member attached to the upper member by at least one hinge, wherein the upper surface and the bottom surface are opposed; and the upper and lower members are in approximately the shape of a circle sector; a plurality of retention spikes extending from the upper surface of the upper member toward the bottom surface of the lower member; at least one retaining tab extending from the rear wall of the lower member; a plurality of ribs formed on the bottom surface of the lower member and extending toward the upper surface of the upper member and radially between a radial center of the bottom surface towards the rear wall; wherein the upper and lower members are movable with respect to one another between an open position and a closed position.

According to another embodiment, a pizza slice container comprises a member formed to approximate the shape of a slice of pizza, the member comprising an upper member formed to approximate the shape of toppings of a slice of pizza, and a lower member formed to approximate the shape of crust of a slice of pizza; the upper member having an upper surface and the lower member having a bottom surface, wherein the upper surface and the bottom surface are opposed; wherein the upper and lower members are movable between an open position and a closed position.

According to yet another embodiment, a method of transporting a slice of pizza comprises placing a slice of pizza inside a pizza slice container formed to approximate the shape of the slice of pizza, the member comprising an upper member formed to approximate the shape of toppings of the slice of pizza, and a lower member formed to approximate the shape of crust of the slice of pizza; retaining the slice of pizza inside the pizza slice container with at least one retaining tab; maintaining an air gap between a bottom surface of the lower member and the slice of pizza with at least one rib; and retaining the toppings of the slice of pizza in a predetermined position with at least one retention spike.

BRIEF DESCRIPTION OF THE DRAWINGS

The features and advantages of the invention will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. For example, a pizza slice is used for illustrative purposes in the title and description of the embodiments of the present invention. However, the invention is not intended to be limited to the specific terminology so selected and may be configured for other types of foods and for foods of different shapes. A person skilled in the relevant art will recognize that other equivalent parts can be employed and other methods developed without departing from the spirit and scope of the invention.

Figure 1:
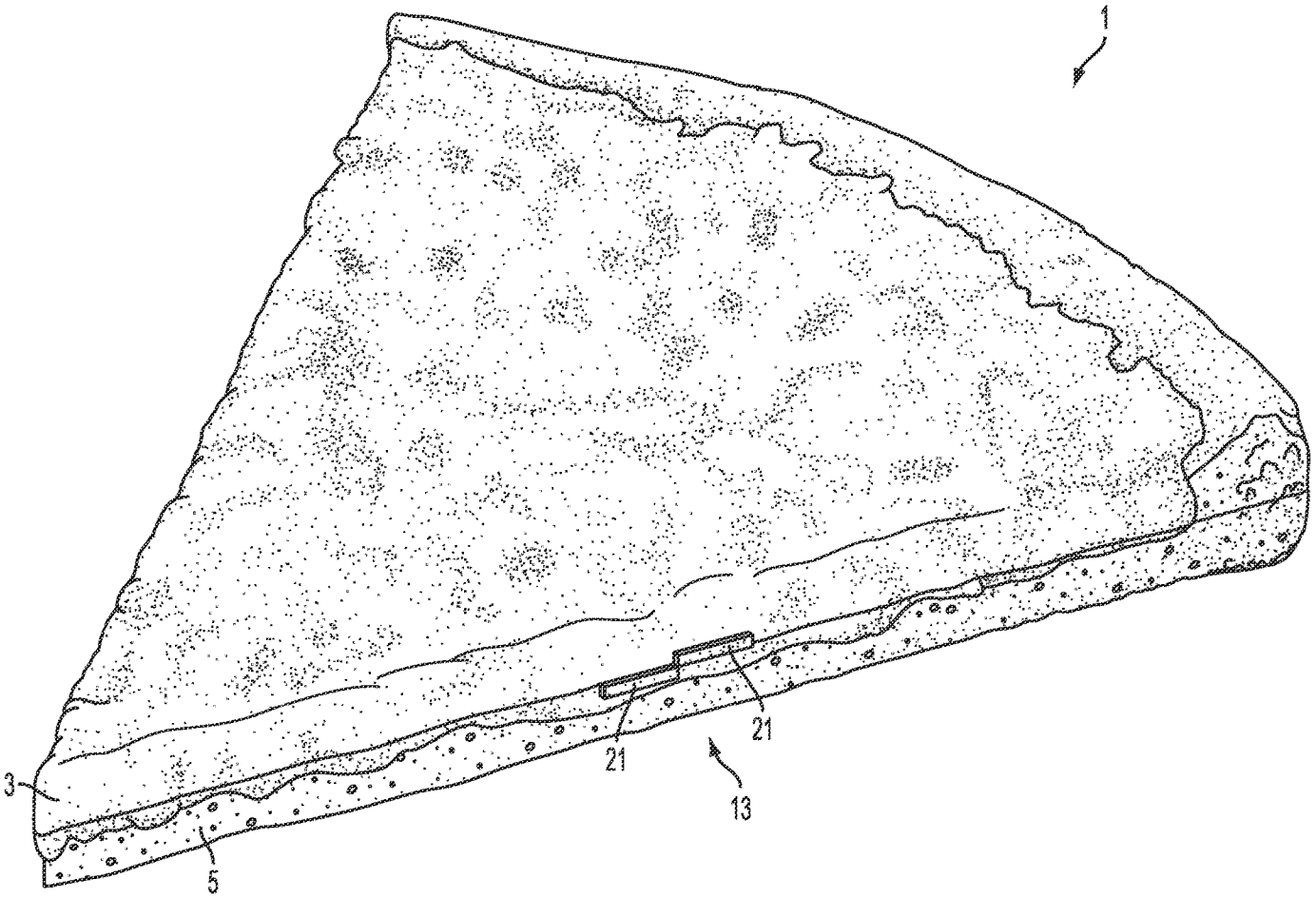
FIG. 1 is a top perspective view of a first embodiment of a pizza slice container in a closed position.

An embodiment of a pizza slice container 1 is shown on FIG. 1. The pizza slice container 1 generally comprises an upper member 3 and a lower member 5 for receiving a sector of a circularly shaped food object (e.g., roughly triangular) such as, for example, a slice of pizza or a slice of pie. According to an embodiment, the upper member 3 is formed to approximate the appearance of toppings of a pizza and the lower member 5 is formed to approximate the appearance of crust of a pizza. According to different embodiments, the upper and lower members may be formed to approximate different elements. For example, in FIG. 1 the upper member 3 is formed to approximate a cheese topping and the lower member 5 is formed to approximate a pizza crust. As a further example, in FIG. 9 the upper member 3 is formed to approximate a pepperoni and cheese topping and the lower member 5 is formed to approximate a pizza crust. It is also foreseen that other embodiments may include, for example, the upper member 3 is formed to approximate a pie crust and the lower member 5 is formed to approximate a pie filling. Further variations in appearance will be apparent to those skilled in the art based on this disclosure.

Figure 2:
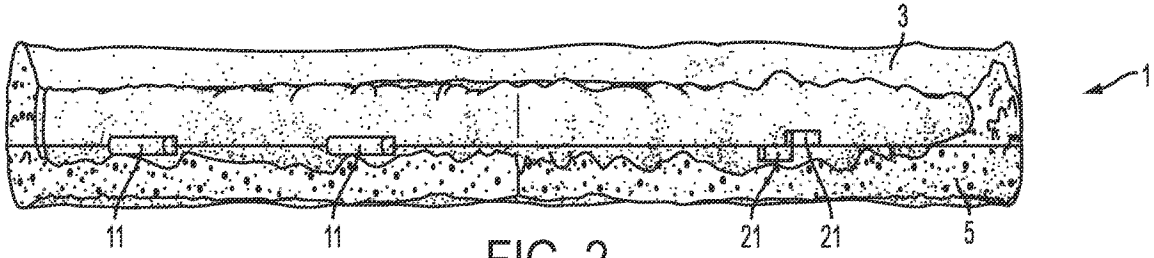
FIG. 2 is a front elevational view of the pizza slice container of FIG. 1.
Figure 3:
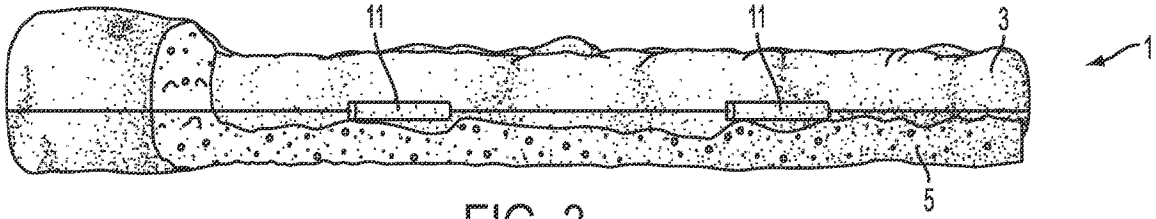
FIG. 3 is a left side elevational view of the pizza slice container of FIG. 1.
Figure 4:
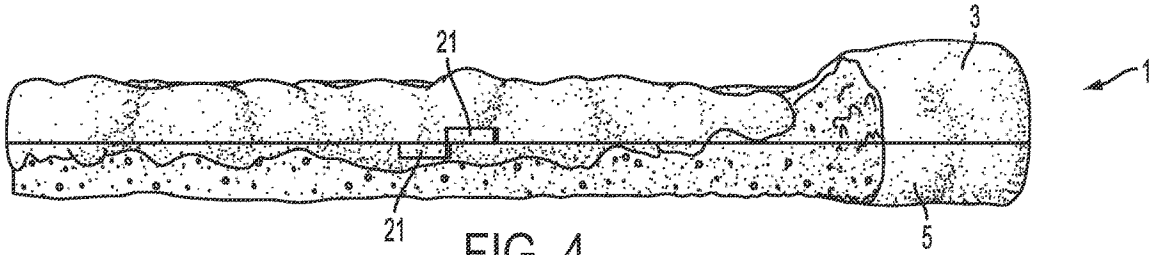
FIG. 4 is a right side elevational view of the pizza slice container of FIG. 1.
Figure 5:
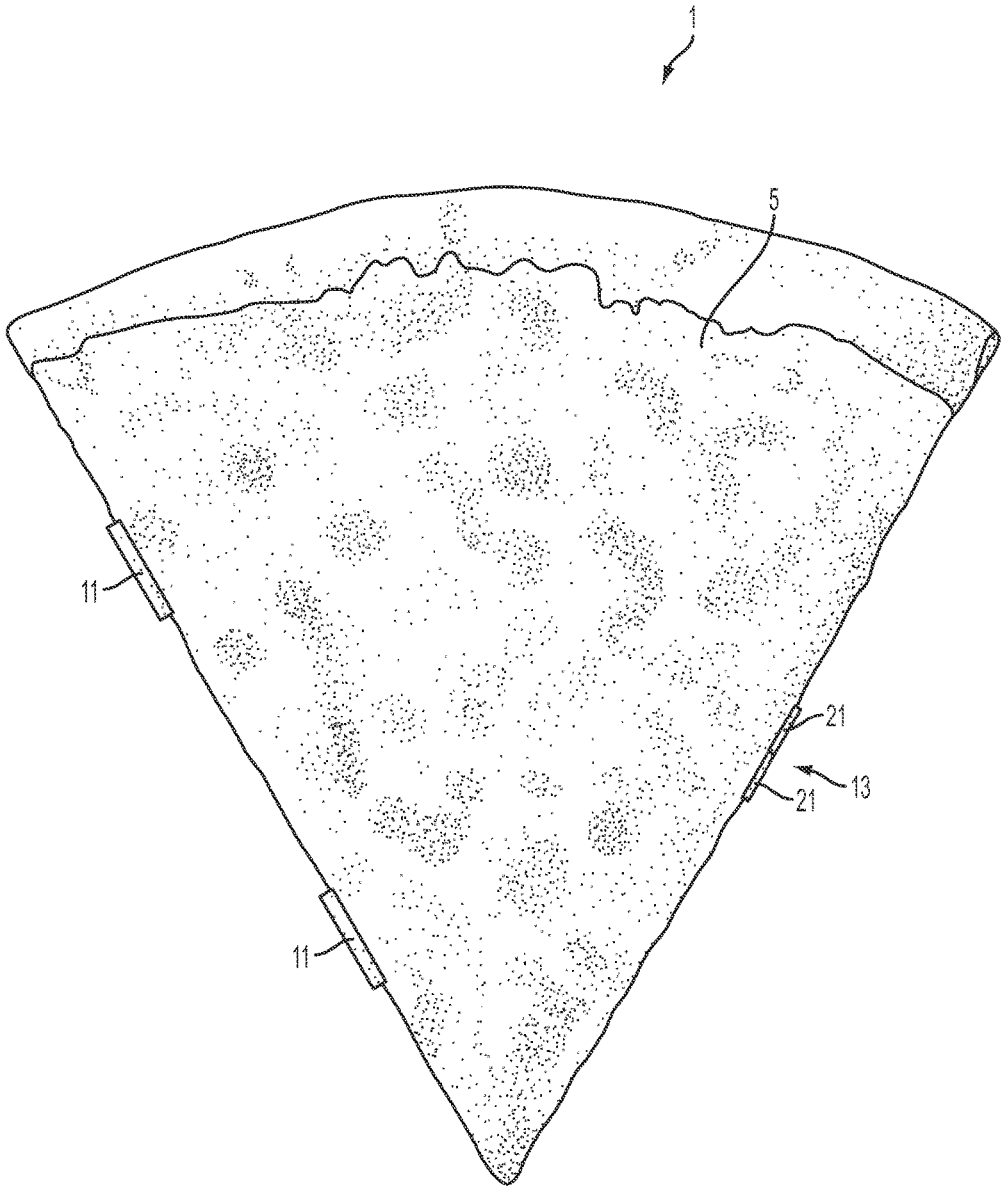
FIG. 5 is a top view of the pizza slice container of FIG. 1.

The upper and lower members 3 and 5 may be formed from a variety of materials including plastics, such as high-density polyethylene, low-density polyethylene, or polypropylene, for example. The upper and lower members may also be formed from glass, metal, or paper-based products. The upper and lower members 3 and 5 may be of substantially rigid material or a pliable material, such as silicon. The upper and lower members 3 and 5 may be formed by injection molding of plastics and other manufacturing techniques as known to one of ordinary skill in the art. According to an embodiment, the upper and lower members 3 and 5 may be formed monolithically. According to another embodiment, the upper and lower members 3 and 5 including the various features shown in, for example, FIGS. 6 and 7, may be formed monolithically. Alternatively, upper and lower members 3 and 5 may be formed separately and subsequently attached. An insulating material may be used to store hot or cold foods. As shown in FIGS. 2, 3, and 4, the upper and lower members 3 and 5 may be formed to approximate the shape of the toppings and crust, respectively. According to an embodiment, the toppings and crust may be colored to depict the actual color of the toppings and crust. According to another embodiment, the upper and lower members 3 and 5 may comprise flat surfaces with the toppings and crust drawn or colored on the outer surface of the members. Alternatively, the pizza slice container 1 may be a single color.

Figure 7:
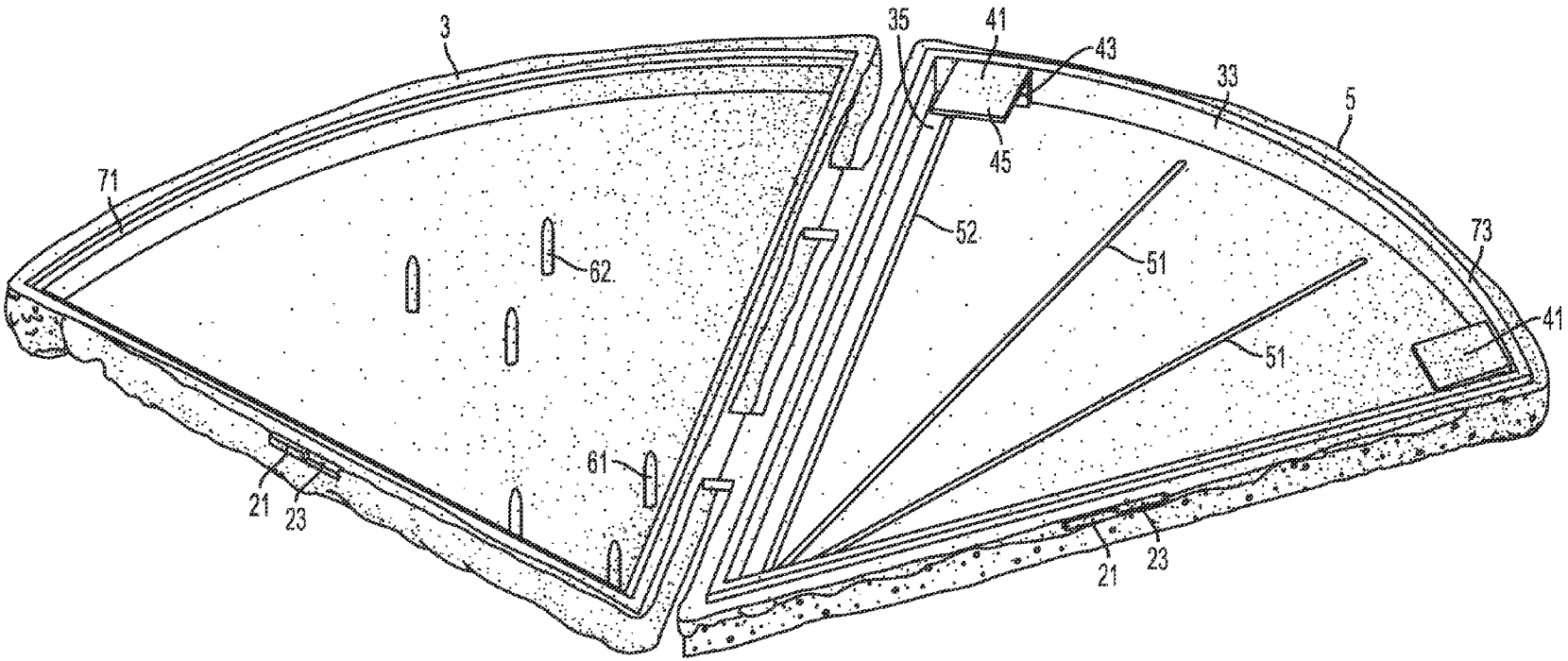
FIG. 7 is a top perspective view of the pizza slice container of FIG. 1 in an open position.

The upper and lower members 3 and 5 may be attached with hinges 11 and a latch mechanism 13 to form a pizza slice container 1 having a closed position, as shown in FIG. 1, and an open position, as shown in FIG. 7. The upper and lower members 3 and 5 may be attached together with at least one hinge 11 located on inner sides of the upper and lower members 3 and 5, respectively. Although two hinges are shown in FIG. 7, it is foreseen that only one hinge may be used or a plurality of hinges may be used. As shown in FIG. 7, the hinges 11 may be a flexible material of and integral with the upper and lower members 3 and 5. For example, the upper and lower members may be made of high-density polyethylene and the hinges may be a thin piece of high-density polyethylene integral with the upper and lower members. According to other embodiments, the hinge 11 may be any type of hinge as known to one of ordinary skill in the art. For example, it is foreseen that a piano hinge, butt hinge, butterfly hinge, flush hinge, or continuous hinge may be used.

Figure 6:
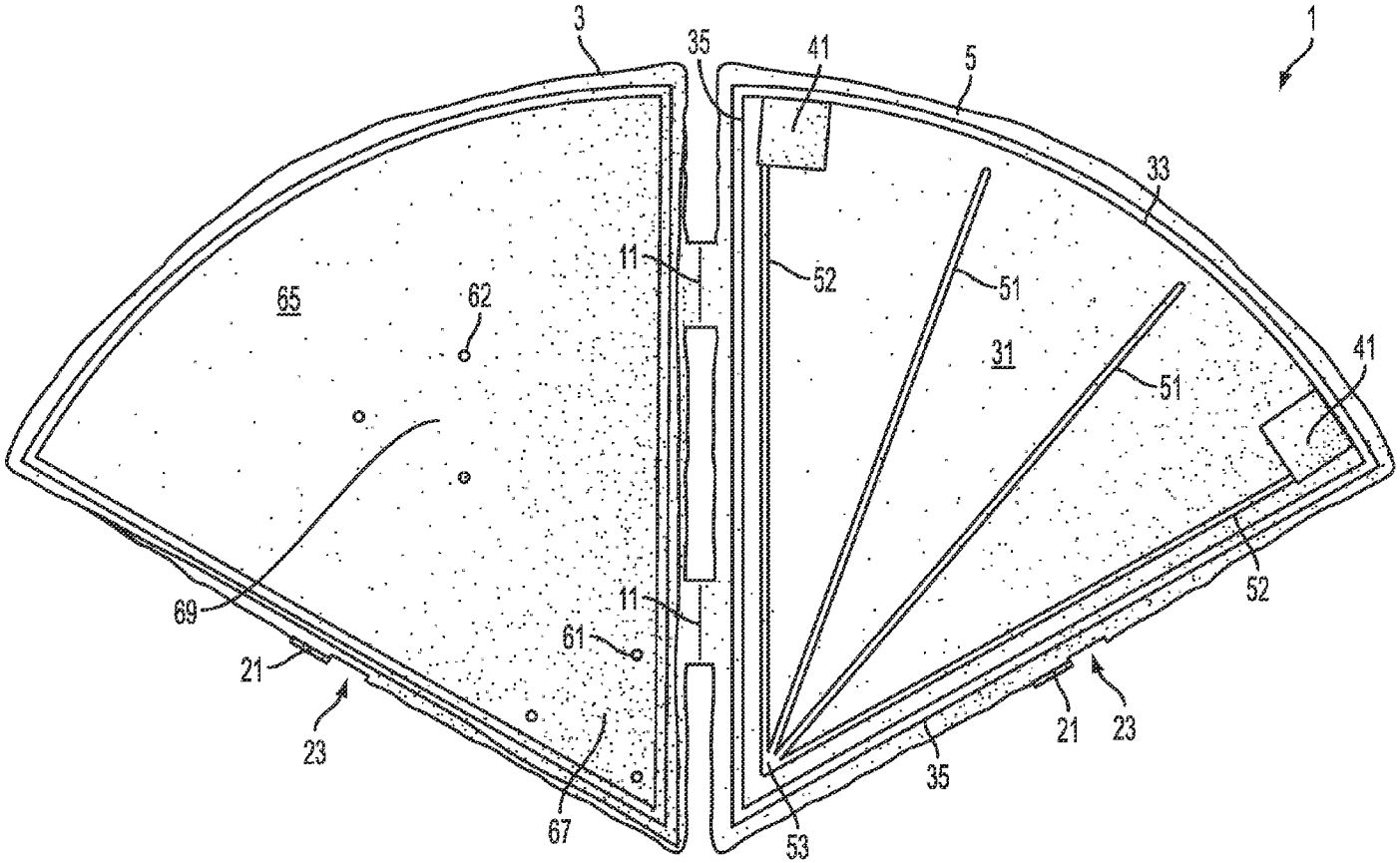
FIG. 6 is a top view of the pizza slice container of FIG. 1 in an open position.

When the upper and lower members 3 and 5 are in the closed position, the upper and lower members 3, 5 may be latched together with a latch mechanism 13. As shown in the embodiment of FIG. 1, a dual snap-fit latch mechanism may be used to latch together the upper and lower members 3 and 5. The snap-fit latch can comprise a cantilevered protrusion 21 and a support receiver 23 on each of the upper and lower members 3 and 5, as shown in FIG. 6, however other embodiments are possible. According to an embodiment, the cantilevered protrusion 21 may include a bead or hook on its free end (not shown). As the upper and lower members 3 and 5 are pushed together to the closed position, the cantilevered protrusion 21 may deflect due to interference between the cantilevered protrusion 21 and the support receiver 23. Once inside the support receiver 23, the interaction between the cantilevered protrusion 21 and the support receiver 23 holds the upper and lower members 3 and 5 together. It is foreseen that the latch mechanism of other embodiments may be a single snap-fit latch mechanism or any type of latch mechanism as known to one of ordinary skill in the art.

Figure 8:
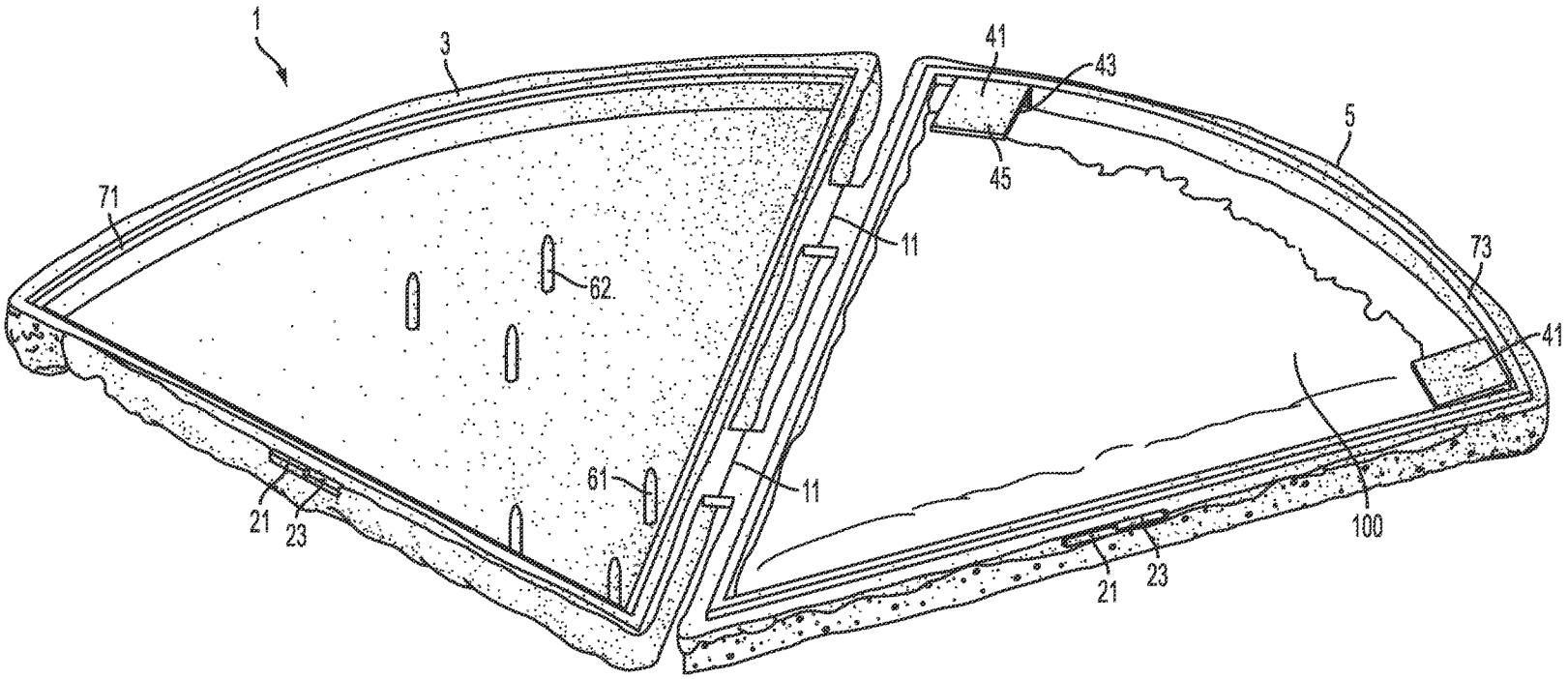
FIG. 8 is a top perspective view of the pizza slice container of FIG. 1 in an open position and having a pizza slice located therein.

Referring now to FIGS. 6, 7, and 8, the pizza slice container 1 is shown in the open position. The inside of the lower member 5 comprises a bottom surface 31, an inner rear wall 33, and inner sidewalls 35. At least one retaining tab 41 can extend radially inwardly from the inner sidewalls 35 or the inner rear wall 33. According to other embodiments, only one retaining tab or a plurality of retaining tabs may be used. The retaining tabs 41 are shown at the corners or distal positions on the inner rear wall 33. In other embodiments, the retaining tabs may be located at a center position between the corners on the inner rear wall 33 or spaced along the inner rear wall 33 between the corners. As shown on FIG. 7, retaining tabs 41 comprise a rear tab portion 43 and a projecting tab portion 45. The rear tab portion 43 can be affixed to the inner rear wall 43 and can provide support for the projecting tab portion 45. The projecting tab portion 45 extends radially inwardly from the rear tab portion 43, e.g., substantially perpendicular thereto, and is spaced away from the bottom surface 31. As shown in FIG. 8, for example, a pizza slice 100 is shown received in the lower member 5 and secured in place by the retaining tabs 41. The retaining tabs 41 may be formed monolithically with the lower member 5 or may be formed separate from the lower member 5 and attached thereto.

The lower member 5 may include air gap ribs 51 and 52 formed on the bottom surface 31. As shown in FIG. 6, the air gap ribs can extend radially from an approximate radial center 53 to substantially adjacent the inner rear wall 33. A pair of outer air gap ribs may 52 extend parallel to the inner side walls 35 of the lower member 5. Another pair of inner air gap ribs 51 may extend between the outer air gap ribs 52. As shown in FIG. 8, for example, a pizza slice 100 is shown received in the lower member 5 and on air gap ribs 51 and 52. The air gap ribs 51 and 52 can elevate the pizza slice 100 or other item placed thereon above the bottom surface 31. According to an embodiment, the air gap ribs 51 and 52 can form an air gap between the bottom surface 31 and the pizza slice 100 or food item in order to preserve freshness. The radial placement of the air gap ribs 51 and 52 on the bottom surface 31 may be advantageous to keep the pizza slice or food item off the bottom surface 31 with a minimum number of air gap ribs required to form the air gap under substantially all of the pizza slice 100 or food item. According to other embodiments, the air gap ribs may be formed vertically, horizontally, or at other angles in order to form the air gap between the bottom surface 31 and the pizza slice 100 or food item. The air gap ribs 51 and 52 may be formed monolithically with the lower member 5 or may be formed separate from the lower member 5 and attached thereto.

Still referring to FIGS. 6, 7, and 8, the upper member 3 may include retention spikes 61 and 62 formed on the upper surface 65. As shown in FIG. 6, the retention spikes 61 and 62 may extend outwardly from the upper surface 65 of the upper member 3. It is foreseen that the retention spikes 61 and 62 may be formed integrally with the upper surface 65 or affixed to the upper surface 65. According to an embodiment, a set of retention spikes 61 is formed near and/or at the radial center 67 of the upper member 3 and another set of retention spikes 62 is formed near and/or at the geometric center 69 of the upper member 3. The placement of retention spikes 61 and 62 may be advantageous for retention of toppings on a slice of pizza. For example, when the pizza slice container 1 of FIG. 8 is in the closed position, the retention spikes 61 and 62 may pass through the toppings (e.g., cheese, pepperoni, peppers, anchovies, etc.) of the pizza slice and into the crust. Alternatively, the retention spikes 61 and 62 may be sized to apply pressure on the toppings of the pizza against the crust. When the closed pizza slice container 1 containing a slice of pizza is jostled or tilted, the pizza toppings may be less likely to slide or become misplaced because they are held in place by the retention spikes 61 and 62. According to other embodiments, retention spikes may be formed at other locations on the upper surface 65 such as along the periphery of the upper member 3. The retention spikes may be formed monolithically with the upper member 3 or may be formed separately and subsequently attached thereto.

Referring now to FIGS. 7 and 8, the pizza slice container 1 may further include a groove 71 and a ridge 73 for containing the pizza slice or food item ingredients within the container 1. The groove 71 may be formed along the periphery of the upper member 3 and a mating ridge 73 may be formed along the periphery of the lower member 5. The groove 71 and mating ridge 73 facilitate alignment of the upper and lower members 3, 5 upon moving the pizza slice container 1 to the closed position. According to an embodiment, the mating groove 71 and ridge 73 may form a seal along the periphery of the mating surfaces of the upper and lower members 3 and 5. Alternatively, when air flow is desired, the mating groove 71 and ridge 73 may form a tortuous flow path in order to allow air flow outside the container but substantially maintain food contents insider the container.

Figure 11:
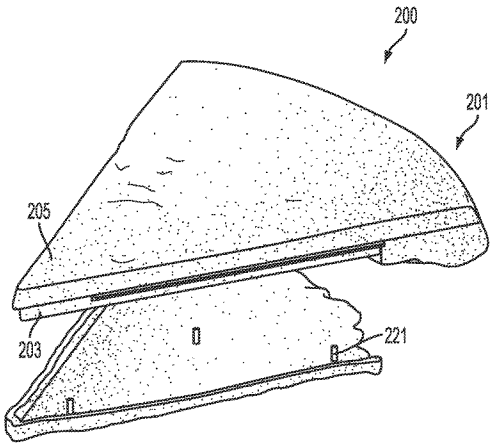
FIG. 11 is a bottom perspective exploded view of the pizza slice container of FIG. 10 in a closed position.
Figure 10:
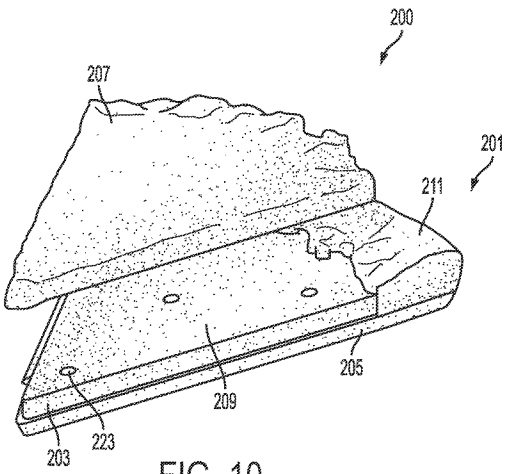
FIG. 10 is a top perspective exploded view of a third embodiment of a pizza slice container in a closed position.

Referring now to FIGS. 10-13, an embodiment of a pizza slice container 200 is illustrated. The pizza slice container 200 may generally comprise a container portion 201 having an upper member 203 and a lower member 205 for receiving a sector of a circularly shaped object. As illustrated at FIGS. 10 and 11, a topping member 207 may be removably attached to a top surface 209 of the upper member 203.

Figure 9:
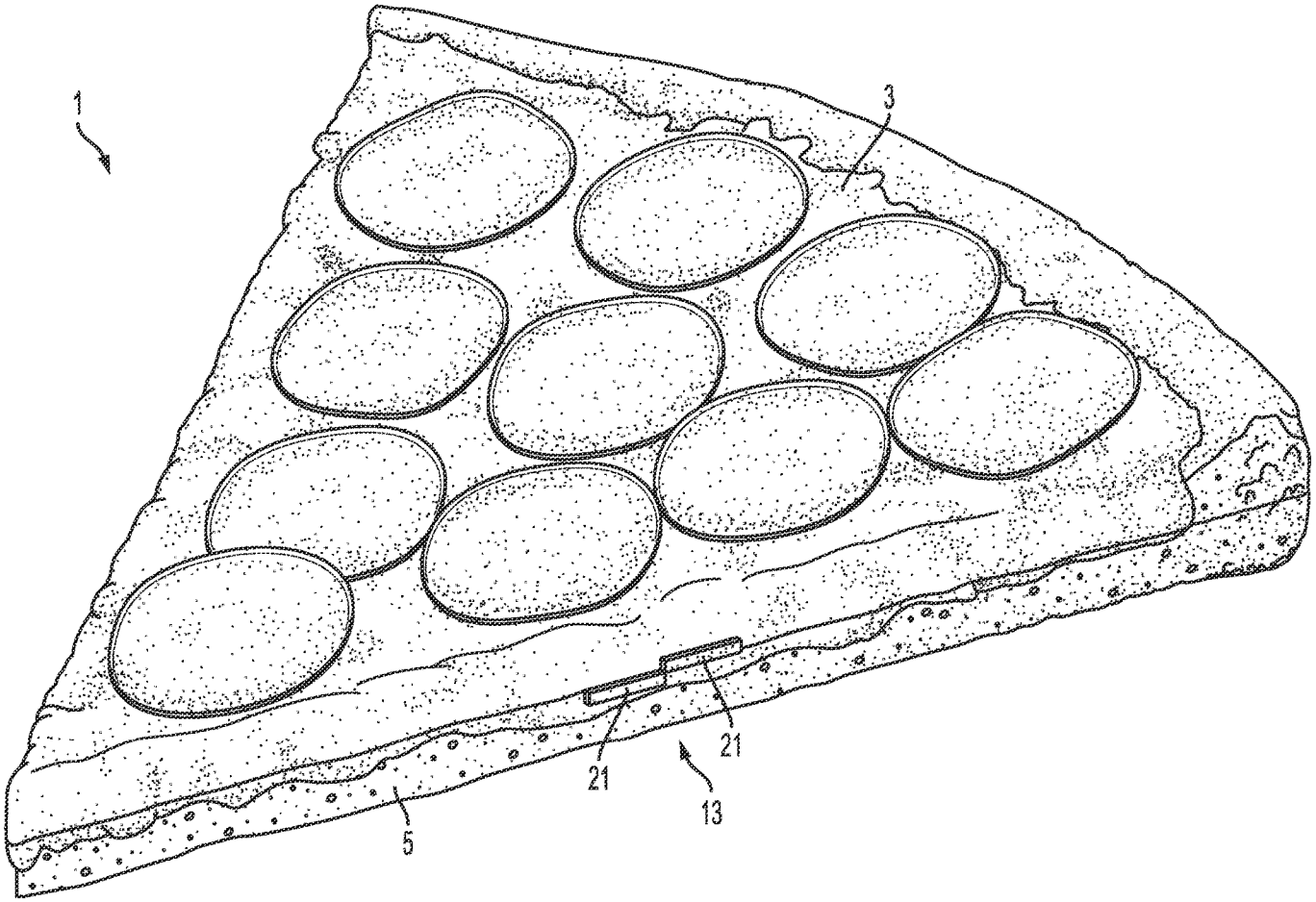
FIG. 9 is a top perspective view of a second embodiment of a pizza slice container in a closed position.

The removable topping member 207 may be formed to emulate any shape, such as, for example, any type of pizza topping, different colors, or different words, numbers, or pictures depicted thereon. As illustrated at FIG. 10, for example, the topping member 207 is a cheese topping. However, the removable topping member 207 may be a pepperoni topping, as illustrated at FIG. 9, or any other type of pizza topping. It is foreseen that the removable topping member 207 may be formed with various colors, textures, and shapes, as desired.

The upper member 203 of the container portion 201 may comprise the substantially flat top surface 209 and an end section 211. For example, the end section 211 may be a crust portion of a pizza. According to an embodiment, the end section 211 may be a fixed decorative element formed on the upper member 203 and the removable topping member 207 may be a variable decorative element of the pizza slice container 200. The mating edges of the end section 211 and topping member 207 may be non-linear or irregular so as to appear more realistic of a real pizza slice. It is foreseen, for example, that a single container portion 201 may have any plurality of interchangeable and removable topping members 207 that depict different types of objects or foods that may be contained within the container portion 201. It is also foreseen that the end section 211 may be formed integral with the removable topping member 207, and removable from the upper member 203, so that both sections 211 and 207 may be variable. According to an embodiment, it is foreseen that the topping member 207 may be permanently attached to the container portion 201.

As illustrated at FIGS. 10 and 11, the topping member 207 may be removably attached to the upper member 203 of the pizza slice container 200. The topping member 207 may have any plurality of posts 221 extending downwardly from an inner surface of the topping member 207. As explained further below, the posts 221 may serve to both attach the topping member 207 to the upper member 203, as well as to function as topping retention spikes, such as retention spikes 61 and 62, explained above. According to an embodiment, the posts 221 may serve only to attach the topping member 207 to the upper member 203. According to another embodiment, only one or only two posts 221 may extend from the topping member 203.

In order to attach the topping member 207 to the upper member 203, the upper member 203 may have post receiving holes 223 extending through the top surface 209 of the upper member 203. The number of post receiving holes 223 may correspond in location and number to the posts 221 extending from the topping member 207. For example, the locations of the posts 221 and corresponding receiving holes 223 may be placed similar to the retention spikes 61 and 62, as explained above.

Figure 12:
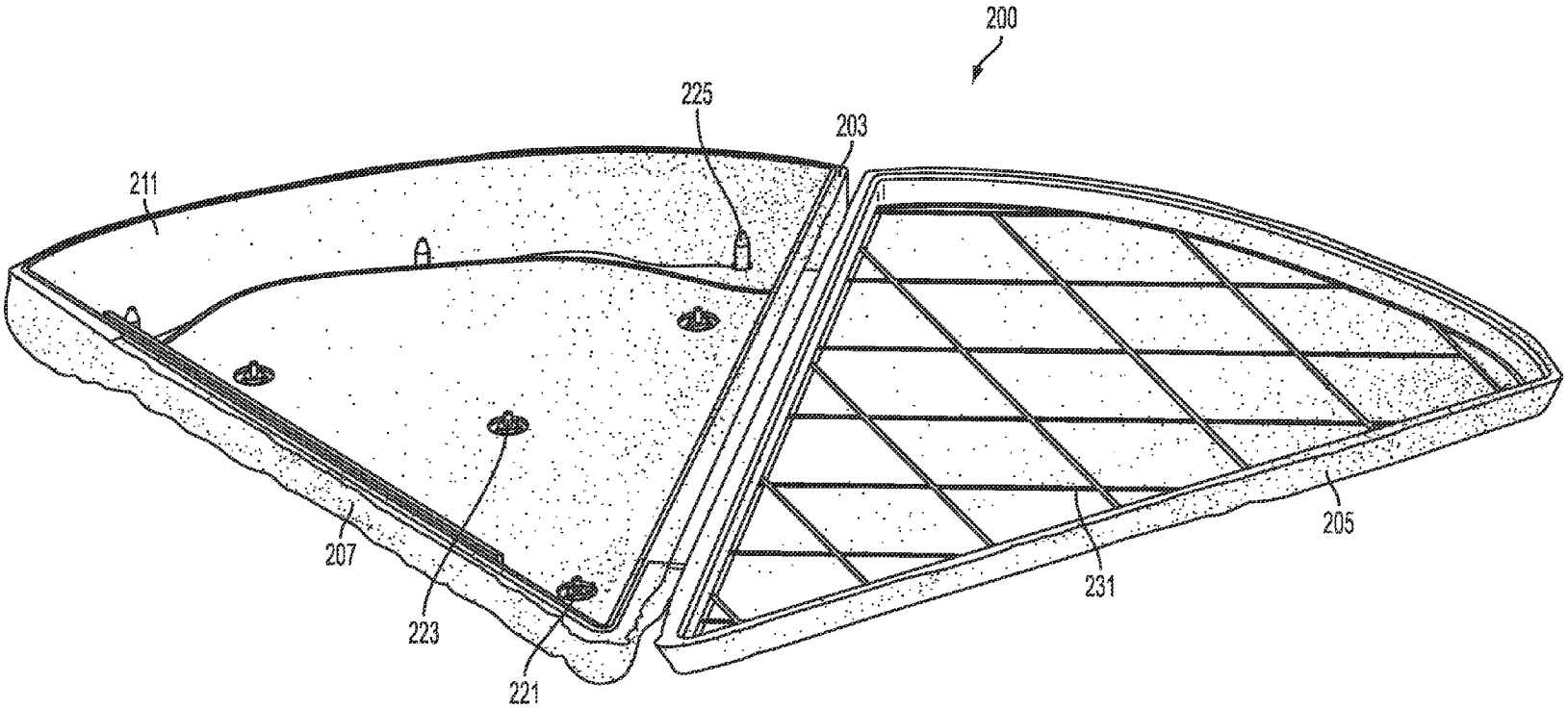
FIG. 12 is a top perspective view of the pizza slice container of FIG. 10 in an open position.
Figure 13:
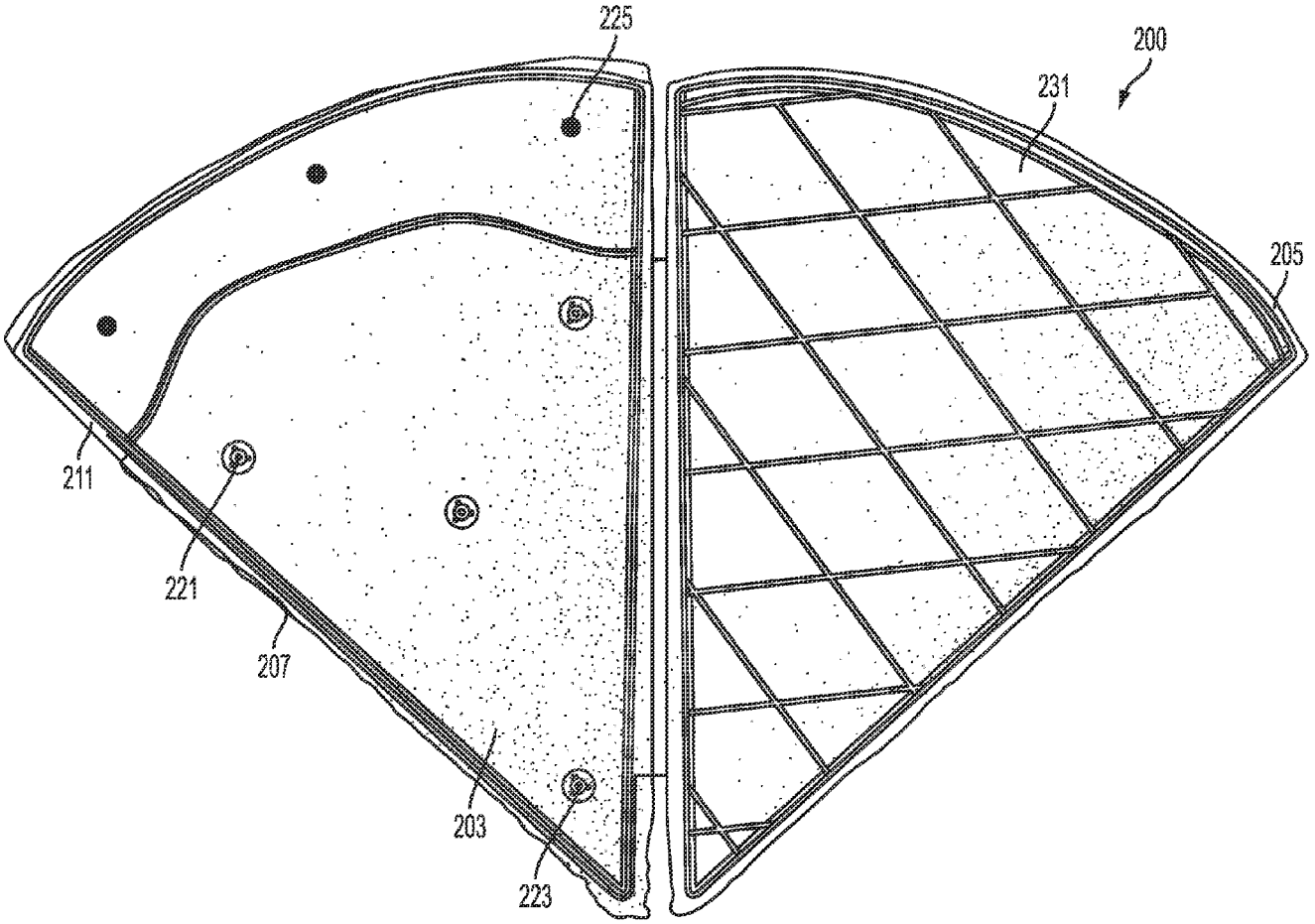
FIG. 13 is a top view of the pizza slice container of FIG. 10 in an open position.

As illustrated at FIGS. 12 and 13, when the topping member 207 is placed on the upper member 203, the posts 221 of the topping member 207 are received into or through the post receiving holes 223. The posts 221 may be received through the post receiving holes 223 by, for example, a friction fit, so as to fixedly but removably attach the topping member 207 to the upper member 203. Other means of fixedly attaching the posts 221 in or through the post receiving holes 223 may be used such as, for example, adhesives, a nut, a threaded nut, or other devices.

As illustrated at FIG. 12, when the topping member 207 is attached to the upper member 203, the posts 221 extend downwardly into the container portion 201. It is foreseen that the length of the posts 221 may be adjusted to any length depending on whether it is desired to pass through the toppings or merely apply pressure to a food item or toppings of a food item placed in the container portion 201. Retention spikes 225 may extend downwardly from the end section 211. According to an embodiment, retention spikes 225 may extend from a removable section corresponding to the pizza crust so that the removable section is removably attached to the upper member 203 in a fashion similar to that of the topping member 207.

Referring now to FIGS. 12 and 13, the inside bottom surface of the lower member 205 of the container portion 201 may have at least one or a plurality of air gap ribs 231. For example, the air gap ribs 231 may be in a cris-cross or overlapping pattern. However, as explained above with respect to air gap ribs 51 and 52, the air gap ribs 231 may be in other patterns such as, for example, radially extending ribs, circular ribs, or at various angles.

Other aspects of the pizza slice container 200 may be similar to those of the previously described embodiments. It is foreseen that the aspects and features of the various embodiments described herein may be used in combination with each other.

The pizza slice containers 1 and 200 of the described embodiments may be used to store and transport a pizza slice or other food items. Advantageously, the container may be formed and colored to approximate the appearance of contents of the container, as described above. According to another embodiment, a pizza shop may use the pizza slice containers to identify the contents of the container for customers either by sight, texture, or both. A freshly baked slice of pizza may be inserted into the pizza slice container where freshness of the crust, placement of the toppings, and/or the desired temperature may be preserved for a period of time. For example, a pizza shop customer may simply look at a variety of pizza slice containers, such as the pizza slice containers of FIGS. 1 and 9, and select the pizza slice desired. Additionally, the pizza shop customer may feel the texture of the of the pizza slice container to select the desired slice of pizza. When the desired slice of pizza is selected, the customer may purchase the pizza slice container containing the ready to eat slice of pizza.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. A pizza slice container comprising:

a member formed to approximate the shape of a slice of pizza, the member comprising an upper member, a topping member formed to approximate the shape of toppings of a slice of pizza, and a lower member formed to approximate the shape of a bottom crust of the slice of pizza;

the upper member having an upper surface and the lower member having a bottom surface, wherein the upper surface and the bottom surface are opposed; and the upper member further comprising a planar section and a crust section, the crust section being formed to approximate the shape of a pizza top crust;

wherein the upper and lower members are movable between an open position and a closed position, wherein the topping member is mounted to the upper member and configured to cover the entire planar section and is removable from the upper member, the topping member further comprising a plurality of retention spikes extending from the topping member and through the upper member.

2. The pizza slice container of claim 1, further comprising at least one retaining tab extending substantially perpendicular from a sidewall of the lower member, wherein at least one sidewall includes a rear wall and the retaining tab extends from the rear wall.

3. The pizza slice container of claim 1, the lower member having a bottom surface and at least one sidewall, the pizza slice container having substantially the shape of a circle sector, wherein the sidewall includes a rear wall having a substantially arced shape.

4. The pizza slice container of claim 3, wherein the at least one retaining tab comprises first and second retaining tabs; wherein the first retaining tab is located at one end of the rear wall, and the second retaining tab is located at an other end of the rear wall.

5. The pizza slice container of claim 1, further comprising a groove formed along a periphery of the upper member, and a ridge formed along a periphery of the lower member; wherein the groove and ridge mate when the upper and lower members are positioned in the closed position.

6. The pizza slice container of claim 1, further comprising a latch adapted to secure the upper and lower members in the closed position.

7. The pizza slice container of claim 1, the lower member further comprising a plurality of ribs formed on the bottom surface thereof and extending radially between a radial center of the bottom surface towards a rear wall of the lower member.

8. The pizza slice container of claim 1 further comprising at least one retaining tab extending from a rear wall of the lower member.

* * * * *